US011703808B2

(12) United States Patent
Favre et al.

(10) Patent No.: US 11,703,808 B2
(45) Date of Patent: Jul. 18, 2023

(54) WATCH WITH MECHANICAL OR ELECTRONIC MOVEMENT PROVIDED WITH A STRIKING MECHANISM

(71) Applicant: The Swatch Group Research and Development Ltd, Marin (CH)

(72) Inventors: Jérôme Favre, Neuchâtel (CH); Lionel Paratte, Marin-Epagnier (CH); Laurent Nagy, Liebefeld (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 318 days.

(21) Appl. No.: 17/169,633

(22) Filed: Feb. 8, 2021

(65) Prior Publication Data

US 2021/0311437 A1 Oct. 7, 2021

(30) Foreign Application Priority Data

Mar. 24, 2020 (EP) ..... 20165319

(51) Int. Cl.
*G04C 21/06* (2006.01)

(52) U.S. Cl.
CPC ..... *G04C 21/06* (2013.01)

(58) Field of Classification Search
None
See application file for complete search history.

(56) References Cited

U.S. PATENT DOCUMENTS 3,440,814 A * 4/1969 Reimann ..... G04C 21/18 368/254
3,689,919 A * 9/1972 Ganter ..... G04C 21/06 340/392.1
4,444,513 A * 4/1984 Proellochs ..... G04G 17/083 368/283

(Continued)

FOREIGN PATENT DOCUMENTS

CH 705 303 A1 1/2013
FR 1 335 311 A 8/1963
FR 2 061 680 A1 6/1971

OTHER PUBLICATIONS

Buttet, Translation of CH705303, Jan. 31, 2013.*
European Search Report of EP 20 16 5319 dated Sep. 15, 2020.

*Primary Examiner* — Renee S Luebke
*Assistant Examiner* — Matthew Hwang
(74) *Attorney, Agent, or Firm* — Sughrue Mion, PLLC

(57) ABSTRACT

A watch includes a striking mechanism, including an attached gong (4) and a hammer (15), as well as a battery (6) and an integrated circuit (7) powered by the battery and configured to produce current pulses, and an electrodynamic actuator (17) which is connected to the integrated circuit and configured to receive said pulses, the actuator being integral with the hammer or connected to the hammer to generate in response to the pulses a movement of the hammer from a rest position thereof, the movement being able to actuate an impact of the hammer on the gong. The mechanism also includes a spring (27) connected to the hammer so as to return the hammer to its rest position after the impact. Depending on particular embodiments, the hammer undergoes one or more pre-oscillations before reaching the impact. The hammer and the gong may be provided with attracting magnets.

13 Claims, 4 Drawing Sheets

(56) References Cited

U.S. PATENT DOCUMENTS

| | | | | |
|---|---|---|---|---|
| 2011/0211427 | A1* | 9/2011 | Pesenti | G04B 21/06 368/243 |
| 2012/0063275 | A1* | 3/2012 | Favre | G04B 23/026 368/243 |

* cited by examiner

WATCH WITH MECHANICAL OR ELECTRONIC MOVEMENT PROVIDED WITH A STRIKING MECHANISM

CROSS-REFERENCE TO RELATED APPLICATIONS

This application claims priority to European Patent Application No. 20165319.3 filed Mar. 24, 2020, the entire contents of which are incorporated herein by reference.

TECHNICAL FIELD

The invention relates to a striking mechanism for a watch. Said mechanism is capable of generating one or more sounds to signal an alarm or minute repeaters.

TECHNOLOGICAL BACKGROUND

In mechanical watches provided with a minute repeater system, said system conventionally comprises one or more gongs each consisting of a metal wire generally circular in shape and placed in a plane parallel to the dial of the watch. The metal wire of each gong is generally disposed around the watch movement, in the watch frame and above a plate on which the different parts of the movement are mounted. One end or several ends of each gong are attached, for example by soldering, to a gong-carrier integral with the plate, for example, which may be unique for all the gongs. The other end of each gong can be generally free.

The striking mechanism comprises at least one hammer actuated at the request of the user, to indicate the time by a series of hammer impact noises on the gong. Each hammer is provided with a return spring allowing it to fall back onto the gongs. The energy reserve for a series of strikes comes from a spring-barrel, which is recharged regularly by the user. This type of mechanism is quite complex and bulky and the energy of the impacts is limited and often decreasing with the mechanical unloading of the spring, the interval between the impacts is also dependent on the unloading of the spring. The autonomy of the spring-barrel is ultimately limited, and it often has to be reset after the alarm or audible indication has ended.

Electronic watches of the quartz or other type are also known, provided with a striking system and/or minute repeaters, wherein a piezoelectric actuator acts as a loudspeaker. The striking takes place using an integrated circuit connected to the actuator. The loudspeaker produces a series of sounds for an alarm, or to indicate the time at the user's request. It is clear that this system is less complex and that the autonomy of this type of striking, as well as the volumes are greater than in the case of a mechanical watch. However, the sound produced by this mechanism is synthetic and unattractive compared to the natural sound of a mechanical gong. In addition, in the limited spatial volume of a watch, it is difficult to implement a loudspeaker that is able to reproduce a sound that approximates the sound of mechanical gong.

Patent application FR 1 335 311 A describes a striking mechanism for a timepiece. This mechanism is composed of a gong disposed at least in part around the movement and an electromechanical device comprising at least one hammer to strike the gong by activating a coil mounted on a metal axial rod. The hammer activation is provided by an electric drive.

Patent application CH 705 303 A1 describes a timepiece which comprises a sound mechanism, which comprises a striking mechanism in a sealed part of the case and at least one gong to be activated by the striking mechanism. The hammer is electrically activated to strike the gong.

Patent application FR 2 061 680 A1 describes an electric hour striking mechanism for a timepiece. The mechanism comprises an electromagnet, which is powered by pulses and which acts on a timepiece hammer to strike a bell or a gong.

SUMMARY OF THE INVENTION

The purpose of the invention is therefore to overcome the disadvantages of the prior art by providing a striking mechanism for a watch, which uses a new principle for the generation of one or more sounds from at least one gong.

To this end, the invention relates to a watch provided with a striking mechanism as well as a method for producing sounds by the mechanism, comprising the features defined in the claims.

A watch according to the invention comprises a striking mechanism, comprising at least one attached gong and at least one hammer, as well as an electric energy accumulator, such as a battery. The mechanism also comprises an integrated circuit powered by the electric energy accumulator and configured to produce current pulses, and an electrodynamic actuator, which is connected to the integrated circuit and which is able to receive said pulses, the actuator being integral with the hammer or connected to the hammer so as to generate in response to said pulses a movement of the hammer from a rest position thereof, said movement being able to produce an impact of the hammer on the gong. The mechanism also comprises a return means, such as a spring connected to the hammer so as to return the hammer to its rest position after the impact.

A watch according to the invention may comprise a basic mechanical or electronic horological movement. In both cases, the watch becomes a hybrid watch which overcomes the disadvantages described above. In the first case, the watch comprises a majority of mechanical components supplemented by an electromechanical striking mechanism, which is more compact and able to increase the autonomy, as well as the energy and the uniformity of the impacts compared to the prior art. In the second case, the watch comprises a majority of electronic and/or electromechanical components, as well as a gong which generates a natural sound instead of the synthetic sounds produced by electronic watches of the prior art.

Depending on particular embodiments, the hammer undergoes one or more pre-oscillations before reaching the impact. According to a particular embodiment, the hammer and the gong are provided respectively with attracting magnets.

BRIEF DESCRIPTION OF THE FIGURES

The invention will be described in more detail below using the appended drawings, given by way of non-limiting examples, wherein.

DETAILED DESCRIPTION OF THE INVENTION

Figure 1:
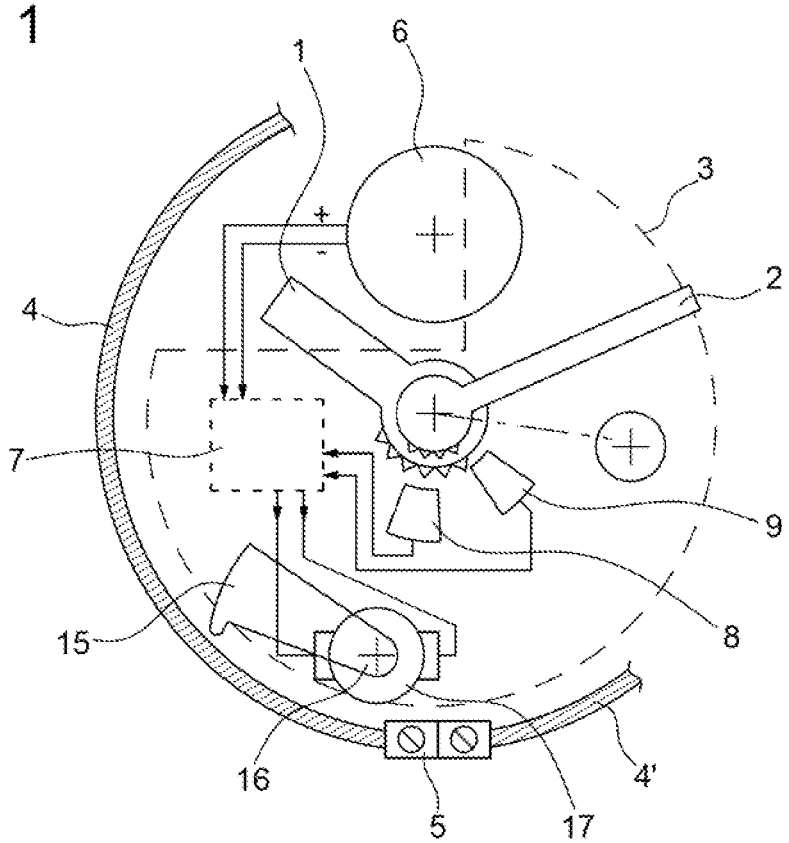
FIG. 1 shows a minute repeater mechanism integrated into a mechanical movement watch according to the invention.

In FIG. 1, the main components of a minute repeater mechanism integrated into a mechanical movement watch can be seen according to the invention. The hour and minute hands 1 and 2 are connected to a conventional mechanical movement 3 shown without details. The minute repeater system comprises a gong 4 attached to the plate (not shown) of the watch by a gong-carrier 5. The gong 4 can be produced according to an embodiment known from the prior art. The minute repeater mechanism further comprises an electric energy accumulator 6, such as a battery, and an integrated circuit 7 powered by the electric energy accumulator 6, as well as detectors 8 and 9 of the position of the axes of the hands 1 and 2. These detectors are also known per se. They can be configured to detect for example, but not limited to the position of a series of teeth provided on the respective axes.

A hammer 15 is rotatably mounted around an axis of rotation 16, so that the hammer can impact the gong 4. The rotation of the hammer 15 is actuable by an electrodynamic actuator 17, which is connected to the integrated circuit 7. The hammer 15 is provided with a spring (not shown) which returns the hammer to its rest position after impact. The actuator 17 receives current pulses generated by the integrated circuit 7, based on the position detected by the detectors 8 and 9, so as to announce the time at the user's request, by a series of specific sounds. Preferably, a second gong 4' and a second hammer provided with its electromechanical actuator (not shown) are present to generate distinct sounds. The dimensions of the actuator 17 and of the hammer 15 are shown only as an indication, but it is clear that all of these components will occupy only a fraction of the space occupied by a purely mechanical striking mechanism, which generally occupies the entire surface of the dial.

Figure 2:
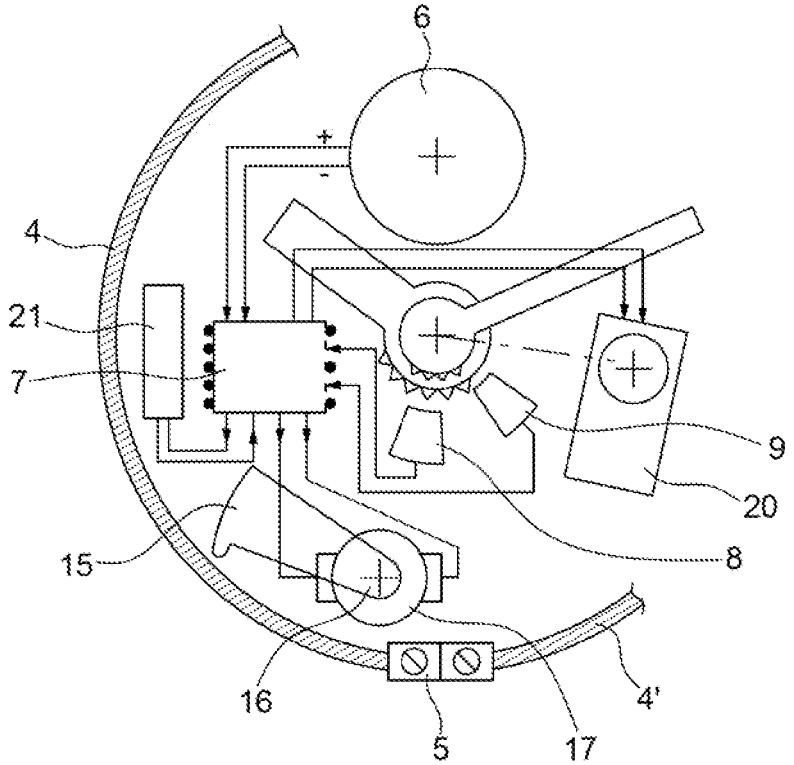
FIG. 2 shows a minute repeater mechanism integrated into an electronic movement watch according to the invention.

FIG. 2 shows an electronic watch of the quartz type according to the invention, also comprising two mechanical gongs 4 and 4' and corresponding hammers 15 and electrodynamic actuators 17 (a single hammer and a single actuator is shown), of the same type and dimensions as in the case of FIG. 1. The hands 1 and 2 are rotated by a motor 20 powered by an electric energy accumulator 6, such as a battery, using an integrated circuit 7 connected to a quartz 21, said components forming part of the electronic movement of the watch, as is known from the prior art. The electrodynamic actuator 17 receives pulses from the integrated circuit 7 of the electronic movement. The presence of detectors 8 and 9 of the position of the axes of the hands 1 and 2 is optional in this embodiment. Instead of having detectors 8 and 9, it is also possible to configure the integrated circuit 7 so that it can determine the time to be announced by the hammers.

Advantageously, a watch according to the invention combines one or more mechanical gongs with a hammer actuated by an electrodynamic actuator. Compared to purely mechanical watches, this solution allows to have a much greater autonomy, a higher sound intensity, an improved repeatability of the pulses, a constant interval between the pulses, as well as a spatial occupation of the striking system which is much less than mechanical striking-systems. In an electronic watch, the invention allows to implement a natural sound for alarms and/or minute repeaters.

Figure 3:
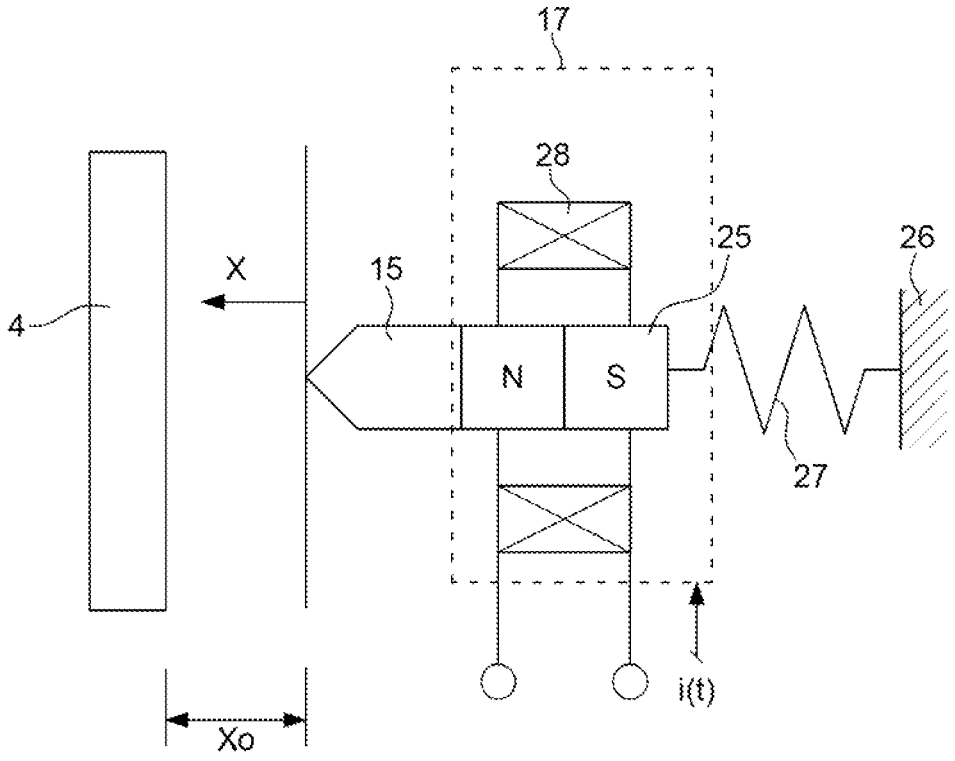
FIG. 3 shows a block diagram of a hammer provided with its electrodynamic actuator as it is applicable in a watch according to the invention.

The volume of impact noises depends on the performance of the electrodynamic actuator used. Tests using an existing electrodynamic vibrator have been made. As can be seen below, the finding is that the energy of a single impact is comparable, but still less than the energy of the impact of a mechanical actuator. However, particular embodiments of the invention are related to the way wherein the current pulses sent to the actuator 17 are configured relative to the rest position of the hammer 15, and relative to a number of parameters of the striking mechanism. A block diagram of the mechanism is shown in FIG. 3. The hammer 15 is integral with a magnet connected to the plate 26 of the watch by a return means 27, which may be a spring. A coil 28 surrounds the magnet 25 and receives the current pulses 1(*t*) generated by a voltage signal U(t), which actuate axial movements of the hammer 15, in the direction x. The magnet 25, coil 28 and spring 27 assembly constitutes the electrodynamic actuator 17. The distance between the gong 4 and the hammer 15 in the rest position is the distance $x_0$ shown in the drawing. In this position, the spring 27 is not prestressed. Depending on the direction of the current I, the movement of the hammer 15 takes place in the direction +x or −x. When the current is interrupted, the spring 27 returns the hammer to the rest position after a number of oscillations determined by the features of the mass-spring system. The system shown in FIG. 3 is equivalent to the system shown in FIGS. 1 and 2, to the extent that in the latter, the spring could be a torsion spring or a leaf spring and the actuator is configured to actuate a rotation of the hammer around the axis 16.

It should be noted that the return means 27 can also be a mechanical cam, or else an electromagnetic force, or another means.

Figure 4A:
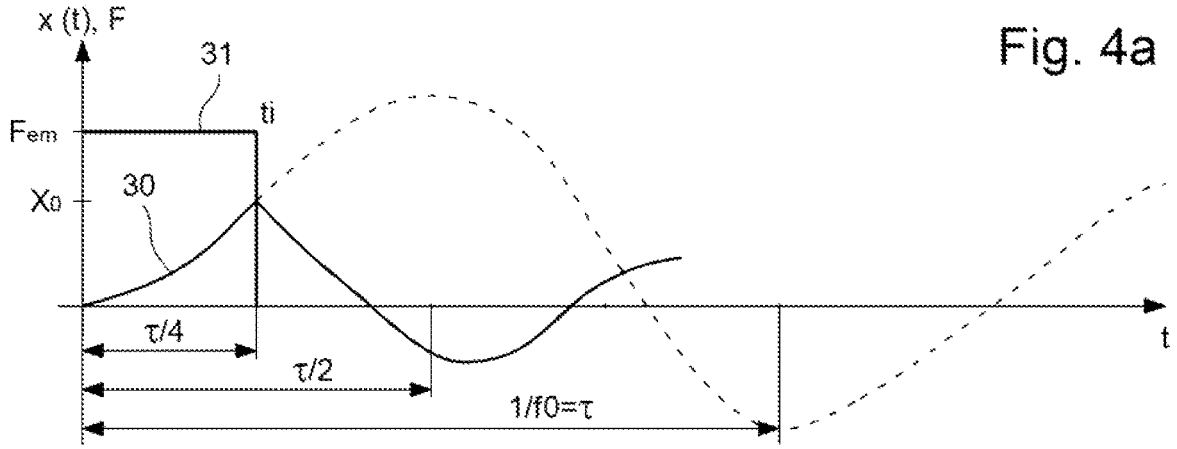
FIG. 4*a* shows a diagram of the pulses and the movements of the hammer by applying a single current pulse.

FIG. 4*a* shows the evolution as a function of the displacement of the hammer 15 for the case of a single current pulse 31 which actuates a movement of the hammer towards the gong 4 until the impact at time $t_i$. The following hypotheses allow to study the movement of the hammer and calculate the energy of the impact:

- The voltage induced by the movement is negligible compared to the applied voltage,
- Voltage, current and electromechanical force $F_{em}$ are considered constant over the duration of the pulse (these are also called peak values). The pulse 31 is effectively shown in the figure as a force pulse $F_{em}$.
- Frictions are neglected,
- The time x(t) is sinusoidal with a period corresponding to the natural frequency $f_0$ of oscillation of the mass-spring system, $f_0$ being given by the formula $f_0=1/2\pi\sqrt{k/m}$ with k the spring constant (N/m) and m the mass of the hammer+magnet (kg).

The magnitude of the electromechanical force $F_{em}$ applied by the pulse is such that the force actuates an oscillation 30 of amplitude $2x_0$. This oscillation is illustrated by curve 30 until the moment of impact $t_i$. If the gong was not present, the oscillation would follow the dotted curve. The time between t=0 and the maximum of the dotted curve corresponds to $$\frac{1}{2}\tau$$

with $\tau=1/f_0$. It can be seen that in the embodiment shown, the duration of the pulse 31 is such that the impact takes place approximately when the speed of the hammer is at its maximum. This implies that the duration of the pulse is approximately $$\frac{\tau}{4}.$$

The law of conservation of energy allows to relate the work of the force $F_{em}$, on the path $x_0$ to the kinetic energy $E_{cin}$ received by the actuator. The electrical balance is also evaluated. It can be shown that the kinetic energy of the impact and the consumed electrical energy are respectively $$E_{cin_1} = F_{em}x_0 - \frac{1}{2}kx_0^2, \tag{1}$$

$$E_{el_1-} = 0.5 \cdot \pi R\sqrt{\frac{m}{k}}\left(\frac{F_{em}}{k_u}\right)^2, \tag{2}$$

with R the electrical resistance (Ohm), and $k_u$ the coil-magnet coupling factor (N/A).

Figure 5:
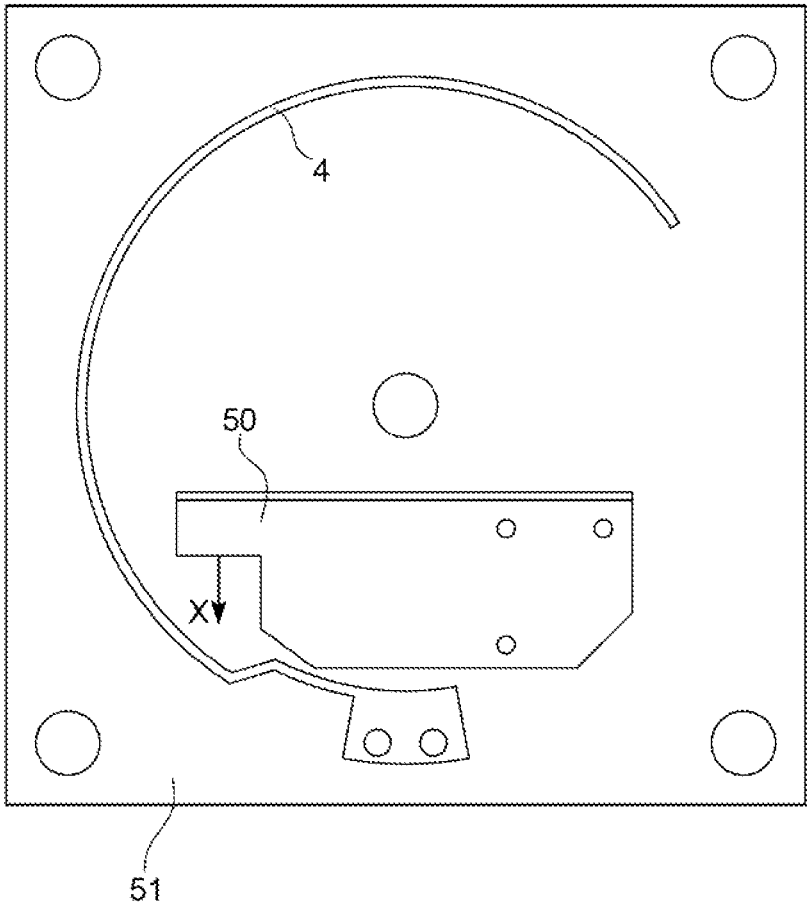
FIG. 5 shows a prototype of a striking mechanism applicable in a watch according to the present invention.

As illustrated in FIG. 5, the test prototype under test used for the actuator-hammer-spring assembly, a vibrator 50 striking a mechanical gong mounted on a brass base 51. The direction x is shown in the drawing. The dimensions are indicated in mm, for example the diameter of the gong may be 35.6 mm, the base 51 may be 44 mm by 44 mm, and the vibrator may be 24.15 mm long and 9.56 mm wide. The values of the parameters that appear in formulas (1) and (2) have been established as follows:

k=1606 N/m, $x_0$=0.19 mm, R=80 Ohm, m=2.68 gr, $k_u$=2.07 [N/A], U=9 V=>I=U/R=112.5 mA, =>$F_{em}=k_u*I$=0.233 N.

With these parameters, the kinetic energy of the impact achieved by the prototype according to the embodiment of FIG. 4*a* was calculated as 15.3 μJ. This is of the same order of magnitude as the impact achieved by a mechanical striking-system, estimated at 50 μJ, but clearly less than the latter. To increase this energy, more powerful current pulses can be applied and/or the actuator can be optimized by modifying its parameters such as the mass, the spring constant and the coupling factor. But as can be seen below, simply adding pre-oscillation pulses greatly increases this energy, even with a non-optimized actuator.

Figure 4B:
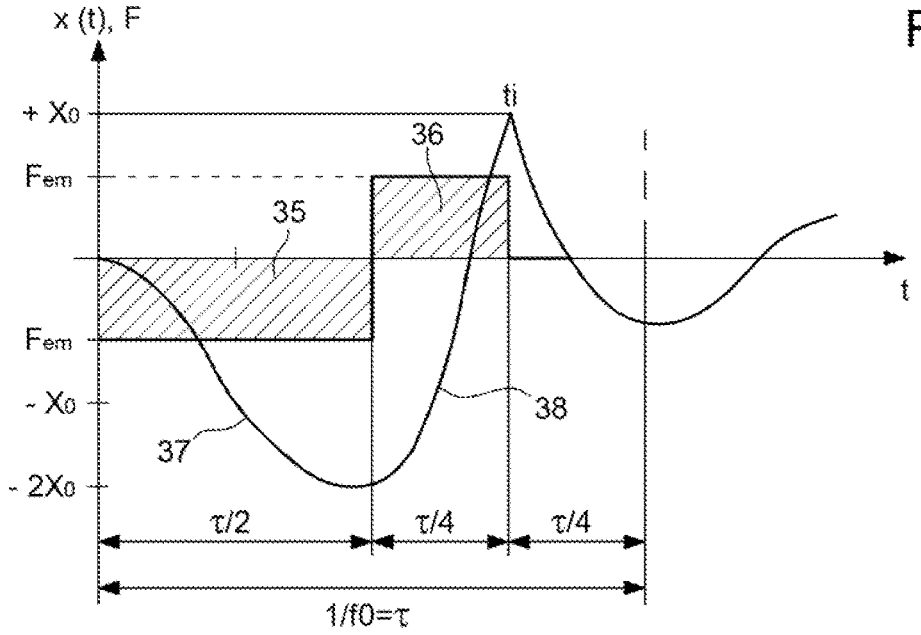
FIGS. 4*b* and 4*c* show diagrams, pulses and movements of the hammer in the case of one or two pre-oscillations of the hammer.

According to another embodiment, the impact energy generated by an electromechanical force equal to or less than the force $F_{em}$ applied for the previous case which uses a single pulse, is increased by actuating the hammer in a different manner, illustrated for example in FIG. 4*b*. According to this embodiment, a first reverse pulse 35 of the same magnitude $F_{em}$ as the single pulse of the previous embodiment is firstly applied. The reverse pulse 35 therefore actuates a negative pre-oscillation 30, having an amplitude of $2x_0$ in the direction −x. When the hammer reaches the extreme point at the position $-2x_0$ (at which the distance between the hammer and the gong equals 3 times $x_0$), the first pulse is followed by a second positive pulse 36 of the same magnitude $F_{em}$, which generates an oscillation 38 which will launch the hammer 15 in the direction of the gong 4 until the impact at time $t_i$, which happens at $$t = \frac{3\tau}{4}.$$

By reasoning in a similar way as before, we obtain this time for the energies:

$$E_{cin_2} = 5 \cdot F_{em}x_0 - \frac{1}{2}kx_0^2, \tag{4}$$

$$E_{el_2-} = 1.5 \cdot \pi R\sqrt{\frac{m}{k}}\left(\frac{F_{em}}{k_u}\right)^2. \tag{5}$$

Figure 4C:
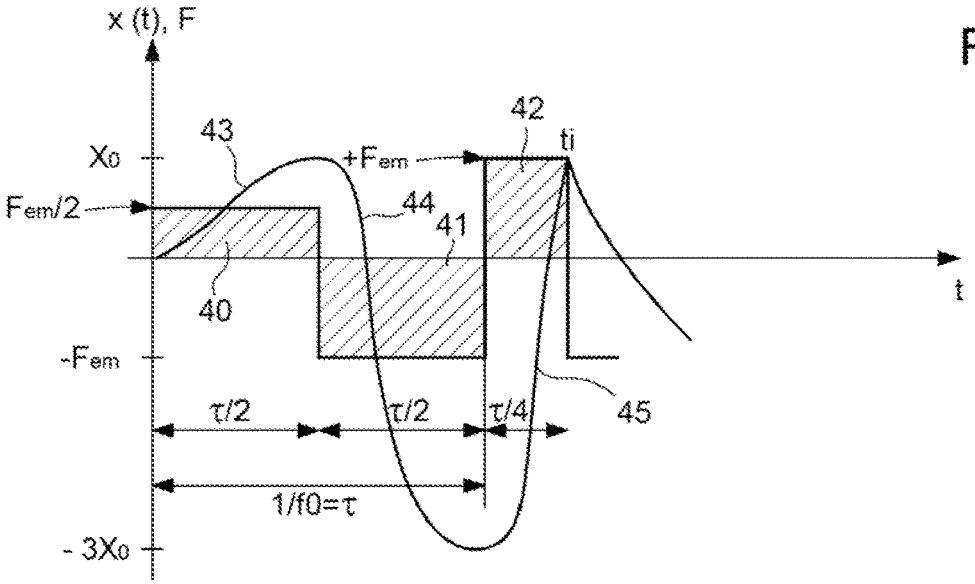

FIG. 4*c* shows the pulses and displacements during a double pre-oscillation. A first positive pulse 40 of magnitude $F_{em}/2$ is applied so that the hammer is brought closer to the gong without touching it by a first pre-oscillation 43, followed at $$t = \frac{\tau}{2}$$

by a second negative pulse 41 of magnitude $F_{em}$, so that a second pre-oscillation 44 brings the hammer back to a distance of $-3x_0$ from the rest position. At the extreme point at $-3x_0$ (at which the distance between the hammer and the gong is 4 times $x_0$), at $t=\tau$, a third positive pulse 42 of magnitude $F_{em}$ generates the final oscillation 45 which throws the hammer towards the gong until the moment of impact $t_i$ happening at $$t = \frac{5\tau}{4}.$$

The energies are given in this case by the following expressions:

$$E_{cin_3} = 8.5 \cdot F_{em}x_0 - \frac{1}{2}kx_0^2, \tag{4}$$

$$E_{el_3} = 1.75 \cdot \pi R\sqrt{\frac{m}{k}}\left(\frac{F_{em}}{k_u}\right)^2. \tag{5}$$

The following table groups together the theoretical performances evaluated in the 2 previous sections:

| Mode of excitation | Kinetic energy | Electrical energy consumed | Multiplicative ratio of $E_{el}$ to reach $E_{cin_3}$ |
|---|---|---|---|
| 1 pulse | $F_{em}x_0 - \frac{1}{2}kx_0^2$ | $0.5 \cdot \pi R\sqrt{\frac{m}{k}}\left(\frac{F_{em}}{k_u}\right)^2$ | 20.6 × |
| 2 pulses | $5 \cdot F_{em}x_0 - \frac{1}{2}kx_0^2$ | $1.5 \cdot \pi R\sqrt{\frac{m}{k}}\left(\frac{F_{em}}{k_u}\right)^2$ | 2.5 × |
| 3 pulses | $8.5 \cdot F_{em}x_0 - \frac{1}{2}kx_0^2$ | $1.75 \cdot \pi R\sqrt{\frac{m}{k}}\left(\frac{F_{em}}{k_u}\right)^2$ | 1 × (reference) |

The right column expresses the multiplicative factor to be applied to the power consumption of the mode in question, to reach the same kinetic energy as with 3 pulses (FIG. 4*c*).

Example $E_{cin}$ (1 pul) requires 8.5×greater force EM to reach $E_{cin}$ (3 pul). However, the consumption will be 8.5^2=72× greater.

But as the consumption ratio is 1.75/0.5=3.5, 8.5^2/3.5=20.6× is finally obtained.

The significant energy gain is clearly seen by applying 1 or 2 pre-oscillations, instead of a single direct pulse. For example, the consumption would increase by a factor of 20.6/2.5=8× in the case where it is sought to obtain the same kinetic energy with a single pulse, as with 2 pulses.

The following table is a numerical application of the 6 formulas above, with the data of the prototype in FIG. 5.

| Mode of excitation | Kinetic energy | Electrical energy consumed | Efficiency $E_{cin}/E_{el}$ |
|---|---|---|---|
| 1 pulse | 15.3 μJ | 2.06 mJ | 0.7% |
| 2 pulses | 192 μJ | 6.17 mJ | 3.1% |
| 3 pulses | 347 μJ | 7.19 mJ | 4.8% |

It is clear that the 50 μJ energy of the mechanical striking-work is greatly exceeded with 2 or 3 pulses.

Since in reality, the simplifications mentioned above are only approximate (for example the friction and the induced voltage are not zero, the frequency is not exactly $f_0$), the embodiments which include at least one pre-oscillation can be formulated as follows: the hammer is actuated so that it undergoes at least two oscillations before reaching the impact, at least one of which is designated 'pre-oscillation', the pre-oscillation(s) being followed by a final oscillation which leads to the impact. In this context, the term 'oscillation' refers to the movement between two consecutive extreme positions of a vibration undergone by the hammer. The oscillations are generated by a series of pulses of opposite signs, so that from the second pulse, each pulse is applied approximately when the hammer reaches an extreme point of the oscillation generated by the previous pulse. In general, the magnitudes of the pulses that generate the pre-oscillations are equal to or less than the magnitude of the pulse that generates the final oscillation.

The number of pre-oscillations can be greater than two, provided that the magnitude of the pulses is adapted to avoid impacts during the pre-oscillations.

By extension to multiple pre-oscillations, it is clear that the applied alternating signal, which is square or otherwise, must have a frequency close to the natural frequency of oscillation of the mass-spring system, so as to effectively amplify the oscillations. This resonance phenomenon is well known to the person skilled in the art.

According to yet another embodiment, the hammer 15 and the gong 4 are provided with attracting magnets, one magnet being fixedly mounted on the gong 4 and the other magnet being fixedly mounted on the hammer 15, so that the magnets are physically contacted at the moment of impact of the hammer on the gong. The force of attraction is such that the hammer and the gong remain in contact while the gong vibrates, until a reverse pulse applied to the electrodynamic actuator causes the hammer to move backward, breaking contact between the magnets. This prolonged contact between the hammer and the gong is able to improve the transfer of kinetic energy from the hammer to the gong. This embodiment can be combined with the methods described above according to which the striking-work is operated without or with pre-oscillations. In the case of several pre-oscillations, their amplitudes must be adjusted to prevent the magnets from sticking the hammer to the gong before the desired moment of impact.

The invention claimed is:

1. A watch provided with a striking mechanism, the mechanism comprising at least one gong attached (4) to a gong-carrier (5), and at least one hammer (15) intended to activate the gong to vibrate it, wherein the striking mechanism further comprises:

an electric energy accumulator (6), an integrated circuit (7) powered by the electric energy accumulator (6) and configured to produce at least one current pulse, an electrodynamic actuator (17) which is connected to the integrated circuit and which is able to receive said pulse(s), the actuator comprising a magnet (25) integral with the hammer (15) or connected to the hammer so as to generate in response to at least one current pulse (31) an oscillation (30) of the hammer (15) from the rest position, and wherein the impact happens approximately when the speed of the hammer during said oscillation is maximum, the actuator also comprising a coil (28) surrounding the magnet (25) and which receives said pulse(s), the oscillation being able to actuate an impact of the hammer on the gong (4), and a return means (27) connected on the one hand to a plate (26) of the watch and on the other hand to the magnet (25) connected to the hammer (15) so as to return the hammer to its rest position after the impact, wherein the integrated circuit (7) is configured to produce a series of pulses of opposite signs so that:

the hammer (15) undergoes at least two oscillations before reaching the impact, at least one of which is designated 'pre-oscillation', the pre-oscillation(s) being followed by a final oscillation which leads to the impact, from the second pulse, each pulse is applied approximately when the hammer reaches the extreme point of the oscillation generated by the previous pulse, and the magnitude of the pulses that generate the pre-oscillations is equal to or less than the magnitude of the pulse that generates the final oscillation.

2. The watch according to claim 1, wherein the watch is a mechanical movement watch (3).

3. The watch according to claim 1, wherein the watch is an electronic movement watch, and wherein the electric energy accumulator (6) and the integrated circuit (7) form part of the watch movement.

4. The watch according to claim 1, wherein the hammer (15) undergoes only a single pre-oscillation (37), followed by the final oscillation (38).

5. The watch according to claim 1, wherein the hammer (15) undergoes two pre-oscillations (43, 44), followed by the final oscillation (45).

6. The watch according to claim 1, wherein the frequency of the pulse(s) is approximately equal to the resonant frequency of the mass-spring system which corresponds to the assembly of the hammer (15) and the return means.

7. The watch according to claim 1, further comprising a pair of attracting magnets, one magnet being fixedly mounted on the gong (4) and the other magnet being fixedly mounted on the hammer (15), so that the magnets are physically contacted at the moment of impact of the hammer on the gong.

8. A method for generating an impact sound in a watch provided with a striking mechanism, the striking mechanism comprising:

at least one gong attached (4) to a gong-carrier (5), at least one hammer (15) intended to activate the gong, an electric energy accumulator (6), an integrated circuit (7) powered by the electric energy accumulator (6) and configured to produce at least one current pulse, an electrodynamic actuator (17) which is connected to the integrated circuit and which is able to receive said pulse(s), the actuator comprising a magnet (25) integral with the hammer (15) or connected to the hammer so as to generate in response to at least one current pulse (31) an oscillation (30) of the hammer (15) from the rest position, and wherein the impact happens approximately when the speed of the hammer during said oscillation is maximum, the actuator also comprising a coil (28) surrounding the magnet (25) and which receives said pulse(s), the oscillation being able to actuate an impact of the hammer on the gong (4), and a return means (27) connected on to a plate (26) of the watch and to the magnet (25) connected to the hammer (15) so as to return the hammer to its rest position after the impact, wherein the method comprises:

a first step of causing the hammer (15) to undergo at least two oscillations before reaching the impact, one of which is a pre-oscillation, the pre-oscillation being followed by a final oscillation which leads to the impact, a second step of, from the second pulse, applying each pulse approximately when the hammer reaches the extreme point of the oscillation generated by the previous pulse, and a third step of setting the magnitude of the pulses that generate the pre-oscillation equal to or less than the magnitude of the pulse that generates the final oscillation.

9. The method according to claim 8, wherein first step includes causing the hammer (15) to undergo only a single pre-oscillation (37), followed by the final oscillation (38).

10. The method according to claim 9, wherein at the end of the pre-oscillation (37), a further step of moving the hammer away from the gong by approximately three times a distance ($x_0$) from the gong to the rest position.

11. The method according to claim 8, wherein the first step includes causing the hammer (15) to undergo two pre-oscillations (43, 44), followed by the final oscillation (45).

12. The method according to claim 11, wherein the first pre-oscillation brings the hammer closer to the gong without touching it, and at the end of the second pre-oscillation (44), the hammer is moved away from the gong by approximately four times the distance ($x_0$) corresponding to the rest position.

13. The method according to claim 8, further comprising a further step of setting the frequency of the pulse(s) approximately equal to the resonant frequency of the mass-spring system which corresponds to the assembly of the hammer (15) and the return means.

* * * * *